US010589355B2

(12) United States Patent
Uenohara et al.

(10) Patent No.: US 10,589,355 B2
(45) Date of Patent: Mar. 17, 2020

(54) METHOD FOR MODIFYING GRAIN BOUNDARY OF ND—FE—B BASE MAGNET, AND BODY WITH MODIFIED GRAIN BOUNDARY TREATED BY THE METHOD

(71) Applicants: Nissan Motor Co., Ltd., Yokohama-shi, Kanagawa (JP); Osaka University, Suita-Shi, Osaka (JP)

(72) Inventors: Masaru Uenohara, Kanagawa (JP); Takashi Furuya, Kanagawa (JP); Koichi Nakazawa, Kanagawa (JP); Shinichirou Fujikawa, Kanagawa (JP); Seiji Kawai, Kanagawa (JP); Kenichi Machida, Osaka (JP); Genya Yamato, Osaka (JP)

(73) Assignees: Nissan Motor Co., Ltd., Yokohama-shi, Kanagawa (JP); Osaka University, Suita-Shi, Osaka (JP)

( * ) Notice: Subject to any disclaimer, the term of this patent is extended or adjusted under 35 U.S.C. 154(b) by 39 days.

(21) Appl. No.: 15/772,465

(22) PCT Filed: Oct. 12, 2016

(86) PCT No.: PCT/JP2016/080258
§ 371 (c)(1),
(2) Date: Apr. 30, 2018

(87) PCT Pub. No.: WO2017/077830
PCT Pub. Date: May 11, 2017

(65) Prior Publication Data

US 2018/0326489 A1 Nov. 15, 2018

(30) Foreign Application Priority Data

Nov. 2, 2015 (JP) ..... 2015-215982

(51) Int. Cl.
*B22F 3/12* (2006.01)
*B22F 3/24* (2006.01)
(Continued)

(52) U.S. Cl.
CPC ..... *B22F 3/12* (2013.01); *B22F 1/0081* (2013.01); *B22F 1/025* (2013.01); *B22F 3/24* (2013.01);
(Continued)

(58) Field of Classification Search
None
See application file for complete search history.

(56) References Cited

U.S. PATENT DOCUMENTS 6,511,552 B1 1/2003 Makita et al.
2008/0006345 A1* 1/2008 MacHida ..... C22C 29/14 148/120
(Continued)

FOREIGN PATENT DOCUMENTS

CN 104752049 A 7/2015
EP 3029689 A2 6/2016
(Continued)

*Primary Examiner* — Colleen P Dunn
*Assistant Examiner* — Michael J Kachmarik
(74) *Attorney, Agent, or Firm* — Young Basile Hanlon & MacFarlane, P.C.

(57) ABSTRACT

An improvement of coercive force of Nd—Fe—B base sintered magnet can be realized while suppressing a decrease in remanent magnetic flux density to the minimum using a method for modifying grain boundary which comprises heat-treating an Nd—Fe—B base magnet with a specific alloy disposed on its surface, the alloy having the following Formula 1:

$$R_xA_yB_z \quad (1)$$

(Continued)

wherein R represents at least one rare earth element including Sc and Y, A represents Ca or Li, B represents an unavoidable impurity, and $2 \leq x \leq 99$, $1 \leq y < x$, and $0 \leq z < y$.

16 Claims, 3 Drawing Sheets

(51) Int. Cl.

| | |
|---|---|
| ***B22F 1/00*** | (2006.01) |
| ***B22F 1/02*** | (2006.01) |
| ***B22F 9/04*** | (2006.01) |
| ***H01F 1/057*** | (2006.01) |
| ***H01F 41/02*** | (2006.01) |
| ***C23C 24/00*** | (2006.01) |
| ***B22F 3/26*** | (2006.01) |
| ***B22F 9/06*** | (2006.01) |
| ***C22C 28/00*** | (2006.01) |
| *C22C 38/00* | (2006.01) |
| *C22C 1/04* | (2006.01) |

(52) U.S. Cl.

CPC ..... *B22F 9/04* (2013.01); *B22F 9/06* (2013.01); *C22C 28/00* (2013.01); *C23C 24/00* (2013.01); *H01F 1/0577* (2013.01); *H01F 41/0293* (2013.01); *B22F 1/0059* (2013.01); *B22F 3/26* (2013.01); *B22F 2003/242* (2013.01); *B22F 2009/041* (2013.01); *B22F 2009/043* (2013.01); *B22F 2998/10* (2013.01); *B22F 2999/00* (2013.01); *C22C 1/0441* (2013.01); *C22C 38/00* (2013.01); *C22C 2202/02* (2013.01)

(56) References Cited

U.S. PATENT DOCUMENTS

| | | | | |
|---|---|---|---|---|
| 2009/0322459 | A1 | 12/2009 | Nagata et al. | |
| 2010/0051139 | A1 | 3/2010 | Nagata et al. | |
| 2011/0150691 | A1 | 6/2011 | Nakamura et al. | |
| 2012/0114515 | A1* | 5/2012 | Kaneko ..... | B22F 1/0088 419/10 |
| 2015/0187494 | A1 | 7/2015 | Lee et al. | |
| 2017/0062103 | A1* | 3/2017 | Wu ..... | H01F 41/0293 |

FOREIGN PATENT DOCUMENTS

| | | | |
|---|---|---|---|
| JP | 2000150213 | A | 5/2000 |
| JP | 2009200425 | A | 9/2009 |
| JP | 2014017480 | A | 1/2014 |
| JP | 2016122863 | A | 7/2016 |
| WO | 2006043348 | A1 | 4/2006 |
| WO | 2006064848 | A1 | 6/2006 |
| WO | 2008032667 | A1 | 3/2008 |

* cited by examiner

[FIG. 2]
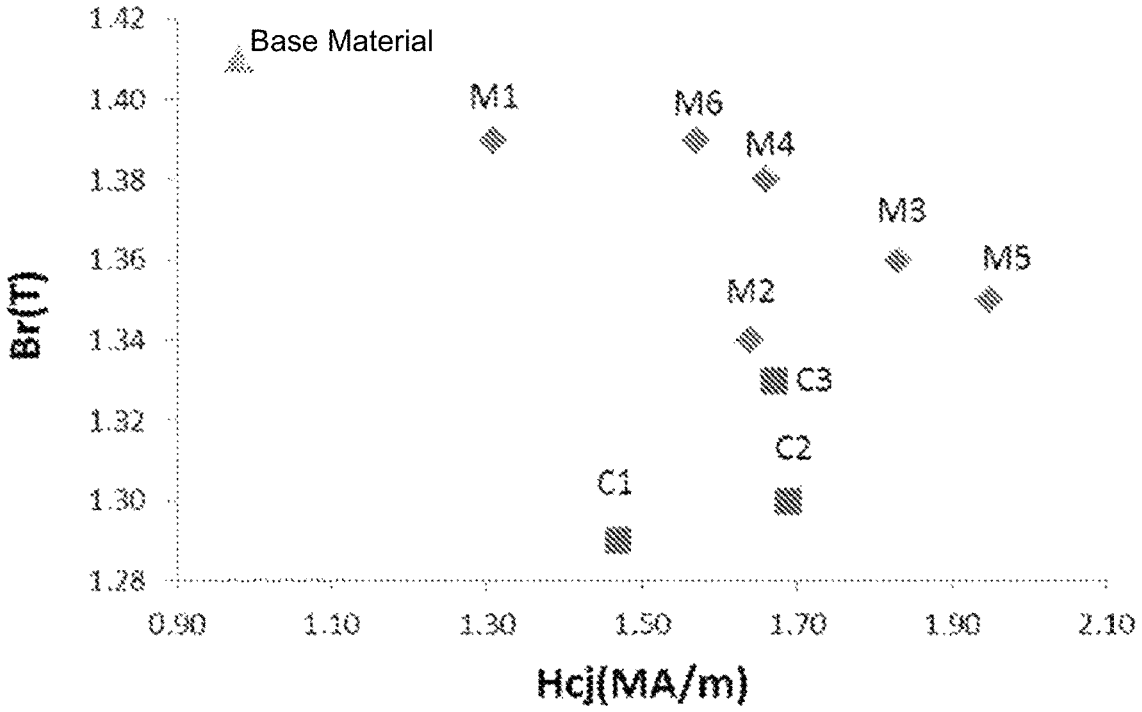

METHOD FOR MODIFYING GRAIN BOUNDARY OF ND—FE—B BASE MAGNET, AND BODY WITH MODIFIED GRAIN BOUNDARY TREATED BY THE METHOD

CROSS-REFERENCE TO RELATED APPLICATION

The present application is based on Japanese Patent Application No. 2015-215982 filed on Nov. 2, 2015, the entire content of which is herein incorporated by reference.

TECHNICAL FIELD

The present invention relates to a method for modifying grain boundary of an Nd—Fe—B base magnet which comprises heat-treating an Nd—Fe—B base magnet with a specific alloy on its surface, and a material with modified grain boundary treated by the method.

BACKGROUND

Conventionally, a ferrite magnet, which is a permanent magnet, has been mainly used for a magnet molded material used in a motor and the like. In recent years, however, an amount of used rare earth magnet with better magnet characteristics has increased in response to high performance and reduced size of a motor.

A rare earth magnet, particularly a rare earth element-iron-boron-base magnet, has been widely used for voice coil motors (VCM) of hard disk drives, magnetic circuits of magnetic resonance imaging (MRI), and the like. In recent years, the applicability has been expanded to driving motors of electric cars. In particular, heat resistance is required for automotive applications, and a magnet having high magnetic characteristics (coercive force ($H_{cJ}$)) is required to avoid high-temperature demagnetization at an environmental temperature of 150 to 200° C.

An Nd—Fe—B base sintered magnet has a microstructure in which a principal phase of an $Nd_2Fe_{14}B$ compound and the like is surrounded by an Nd-rich crystal grain boundary phase (grain boundary phase), and the component composition, size and the like of the principal phase and grain boundary phase play important roles in exerting a coercive force of a magnet. In general sintered magnets, high coercive forces are exerted by containing about a few percent by weight to ten percent by weight of Dy or Tb in a magnet alloy and taking advantages of magnetic properties of a $Dy_2Fe_{14}B$ or $Tb_2Fe_{14}B$ compound having an anisotropic magnetic field larger than that of the $Nd_2Fe_{14}B$ compound. However, there has been a problem in that saturation magnetization is decreased sharply, thereby reducing remanent magnetic flux density (Br), as the content of Dy or Tb is increased. Furthermore, since Dy and Tb are rare resources and are expensive metals costing a few times as much as Nd does, the usage thereof must be reduced.

In order to improve coercive force of Nd—Fe—B base sintered magnet while a decrease in remanent magnetic flux density is suppressed, grain boundary modification technique has been studied such as a grain boundary diffusion method in which rare earth elements such as Dy and Tb are unevenly distributed in a crystal grain boundary phase surrounding the principal phase of $Nd_2Fe_{14}B$ compound and the like. The grain boundary diffusion method is a technique which increases coercive force with a small amount of Dy by diffusing dysprosium fluoride and the like from the surface of a sintered magnet along the crystalline grain boundary and increasing crystal magnetic anisotropy of a thin layer in a crystalline grain boundary portion.

WO 2006/043348 A (corresponding to US 2011/0150691 A) discloses a grain boundary diffusion method which uses an oxide and fluoride, which are relatively cheap, among rare earth elements as a diffusing agent. Specifically, the method is a method for producing a rare earth permanent magnet material which comprises disposing a powder containing an oxide or fluoride of Dy or Tb on the surface of a magnet material, and heat-treating the magnet material and the powder at a temperature equal to or below the sintering temperature of the magnet in vacuum or in an inert gas.

SUMMARY

However, when using compounds such as an oxide or fluoride of a rare earth element as a diffusing agent, there has been a problem in that decrease in remanent magnetic flux density is still great although coercive force is increased to a certain extent by grain boundary modification.

Therefore, the present invention has been made in view of the above circumstances, and an object of the present invention is to provide a method for modifying grain boundary which can improve coercive force of Nd—Fe—B base sintered magnet while suppressing decrease in remanent magnetic flux density to the minimum.

The present inventors have diligently investigated to solve the above problems. As a result, they have found that the above problems could be solved by a method for modifying grain boundary which comprises heat-treating an Nd—Fe—B base magnet with a specific alloy disposed on the surface thereof, thereby completing the present invention.

BRIEF DESCRIPTION OF THE DRAWINGS

FIG. 2 shows measurement results of remanent magnetic flux density ($B_r$) and coercive force ($H_{cJ}$) in Examples and Comparative Examples;

(FIG. 3*b*: Ca, FIG. 3*c*: Tb, FIG. 3*d*: Ca and Tb).

DETAILED DESCRIPTION

Figure 1A:
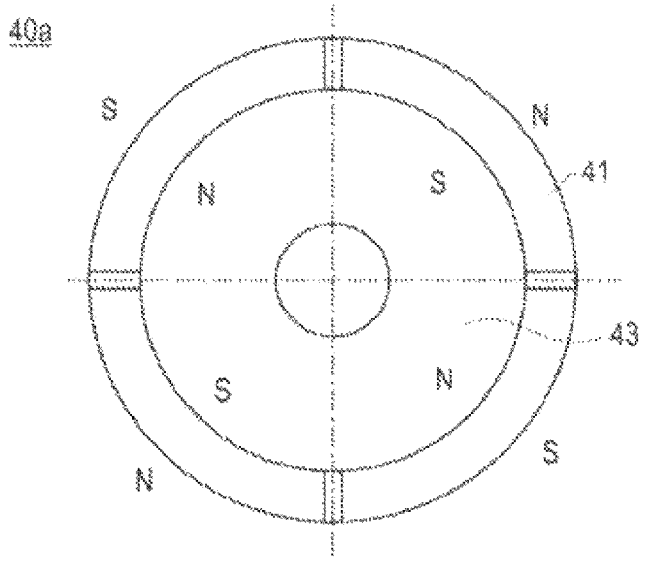
FIG. 1*a* is a cross-sectional schematic view which schematically shows a rotor structure of a surface permanent magnet synchronous motor (SMP or SPMSM).

An aspect of the present invention relates to a method for modifying grain boundary of an Nd—Fe—B base magnet, which includes heat-treating an Nd—Fe—B base magnet with an alloy powder represented by the following formula (1) disposed on the surface thereof in vacuum or in an inert gas at a temperature lower than a sintering temperature of the magnet. Another aspect of the present invention relates to a method for modifying grain boundary of an Nd—Fe—B base magnet, which includes heat-treating an Nd—Fe—B base magnet with an alloy powder represented by the following formula (1) disposed on the surface thereof in vacuum or in an inert gas at a temperature in the range of 200° C. to 1050° C.

[Chemical Formula 1]

$$R_xA_yB_x \quad (1)$$

In the above formula (1), R represents at least one rare earth element including Sc and Y, A represents Ca or Li, B represents an unavoidable impurity, and $2 \leq x \leq 99$, $1 \leq y < x$, and $0 \leq z < y$.

According to the present invention, there can be provided a method for modifying grain boundary which can improve coercive force of Nd—Fe—B base sintered magnet while suppressing decrease in remanent magnetic flux density to the minimum. It is considered that this is because oxidation of a rare earth element in an alloy is prevented by the reduction action of Ca or Li contained in the alloy.

The inside of a general Nd—Fe—B base sintered magnet has a structure in which a grain boundary phase (which has a thickness of about 10 to 100 nanometers, is primarily composed of Nd, Fe, and O, and is referred to as an Nd-rich phase) surrounds around a principal phase (e.g., $Nd_2Fe_{14}B$) with a size of about 3 to 10 microns. While a crystalline grain boundary tends to become a generation source of reverse magnetic domain, coercive force can be increased by diffusing a rare earth element such as Dy along a crystalline grain boundary by a grain boundary diffusion method to increase crystal magnetic anisotropy of a crystalline grain boundary portion. As used herein, a "rare earth element including Sc and Y" is also simply referred to as a "rare earth element". A "Nd—Fe—B base magnet" is also simply referred to as a "magnet." An "alloy powder represented by the formula (1)" is also referred to as an "alloy powder."

In the above Patent Literature 1, the oxide or fluoride of a rare earth element is used as a diffusing agent in a grain boundary diffusion method. Although there is an advantage in that an oxide and fluoride of rare earth element is cheap, there is a problem in that diffusion to a magnet grain boundary does not easily occur due to the presence of the oxygen and fluorine in the compound. It is supposed that this is because the rare earth element is easily incorporated into a principal phase crystal due to the presence of the oxygen and fluorine in the compound. Therefore, it is considered that when using an oxide and fluoride of a rare earth element as a diffusing agent, a content of Dy and Tb in a principal phase crystal increases to induce decrease in remanent magnetic flux density.

On the other hand, the present invention has a feature in using an alloy powder represented by the above formula (1) as a diffusing agent. Since the alloy powder represented by the above formula (1) contains Ca or Li (an oxygen getter) which is easily oxidized, as well as a rare earth element (a rare earth element including Sc and Y), the rare earth element can be prevented from being oxidized due to the presence of Ca or Li (oxygen getter). In addition, diffusibility can be further improved because Ca and Li remove an oxide layer near the surface of a magnet grain boundary. Accordingly, it is supposed that the rare earth element hardly substitutes for Nd in the principal phase crystal, and a structure in which the rare earth element (or the alloy of the formula (1)) is enriched selectively in a crystal grain boundary phase is formed, that is, the grain boundary can be modified. By this, it is considered that by the grain boundary modification method according to the present invention, coercive force of Nd—Fe—B base magnet can be improved while suppressing decrease in remanent magnetic flux density thereof to the minimum.

It should be noted that the above mechanism is a presumption, and does not restrict the technical scope of the present invention.

The embodiments of the present invention will now be described. It should be noted that the present invention is not limited only to the following embodiments.

In the description, "X to Y" showing a range means "X or more and Y or less". In addition, operations and measurement of e.g., physical properties are measured at a room temperature (20 to 25° C.) and relative humidity of 40 to 50% RH, unless otherwise specified.

An Nd—Fe—B base magnet, a target magnet of the present invention, is a sintered magnet. The Nd—Fe—B base sintered magnet has a crystal texture in which an Nd-rich crystal grain boundary phase surrounds principal phase crystal, and exhibits a typical nucleation type coercive force mechanism. By this, the effect of increasing coercive force by the present invention can be more effectively attained.

(1) Preparation of Nd—Fe—B Base Magnet

The grain boundary modification method according to the present invention uses an Nd—Fe—B base magnet having an alloy powder represented by the above formula (1) disposed on the surface thereof.

(a) Nd—Fe—B Base Magnet (Magnet Base Material)

The Nd—Fe—B base magnet (magnet base material) used for the grain boundary modification is not particularly restricted, and conventionally known ones can be used. That is, the Nd—Fe—B base magnet is preferably a magnet having an Nd—Fe—B-base composition, which includes 10 to 20 atomic % of Nd element as a rare earth element as an essential element, 1 to 12 atomic % of B element as an essential element, and Fe element and an unavoidable impurity as the remainder. Such rare earth magnet may optionally include a rare earth element(s) such as Pr, Dy and Tb, and another element(s) such as Co, Ni, Mn, Al, Cu, Nb, Zr, Ti, W, Mo, V, Ga, Zn and Si. Specific examples thereof include, but not restricted to, sintered magnets such as $Nd_2Fe_{14}B$, $Nd_2(Fe_{1-x}Co_x)_{14}B$ ($0 \leq x \leq 0.5$), $Nd_{15}Fe_{77}B_5$, $Nd_{11.77}Fe_{82.35}B_{5.88}$, $Nd_{1.1}Fe_4B_4$, $Nd_7Fe_3B_{10}$, $(Nd_{1-x}Dy_x)_{15}Fe_{77}B_8$ ($0 \leq x \leq 0.4$), $(Nd_{1-x}Tb_x)_{15}Fe_{77}B_8$ ($0 \leq x \leq 0.4$), $(Nd_{0.75}Zr_{0.25})(Fe_{0.7}Co_{0.3})N_x$ ($1 \leq x \leq 6$), $Nd_{15}(Fe_{0.80}Co_{0.20})_{77-x}B_8Al_x$ ($0 \leq x \leq 5$), $(Nd_{0.95}Dy_{0.05})_{15}Fe_{77.5}B_7Al_{0.5}$, $(Nd_{0.95}Tb_{0.05})_{15}Fe_{77.5}B_7Al_{0.5}$, $(Nd_{0.95}Dy_{0.05})_{15}(Fe_{0.95}Co_{0.05})_{77.5}B_{6.5}Al_{0.5}Cu_{0.2}$, $(Nd_{0.95}Tb_{0.05})_{15}(Fe_{0.95}Co_{0.05})_{77.5}B_{6.5}Al_{0.5}Cu_{0.2}$, $Nd_4Fe_{80}B_{20}$, $Nd_{4.5}Fe_{73}Co_3GaB_{18.5}$, $Nd_{5.5}Fe_{66}Cr_5Co_5B_{18.5}$, $Nd_{10}Fe_{74}Co_{10}SiB_5$, $Nd_{3.5}Fe_{78}B_{18.5}$, $Nd_4Fe_{76.5}B_{18.5}$, $Nd_4Fe_{77.5}B_{18.5}$, $Nd_{4.5}Fe_{77}B_{18.5}$, $Nd_{3.5}DyFe_{73}Co_3GaB_{18.5}$, $Nd_{3.5}TbFe_{73}Co_3GaB_{18.5}$, $Nd_{4.5}Fe_{72}Cr_2Co_3B_{18.5}$, $Nd_{4.5}Fe_{73}V_3SiB_{18.5}$, $Nd_{4.5}Fe_{71}Cr_3Co_3B_{18.5}$ and $Nd_{5.5}Fe_{66}Cr_5Co_5B_{18.5}$. These Nd—Fe—B base magnets can be used individually or two or more Nd—Fe—B base magnets can be used in combination. As mentioned above, Nd—Fe—B base magnets which can be used for grain boundary modification also include those which are formed by adding another element(s) in addition to Nd, Fe and B. Examples of the another element(s) which can be added include, but not restricted to, Ga, Al, Zr, Ti, Cr, V, Mo, W, Si, Re, Cu, Zn, Ca, Mn, Ni, C, La, Ce, Pr, Pm, Eu, Gd, Tb, Dy, Ho, Er, Tm, Yb, Lu, Y, Th, and the like. These elements can be added individually, or two or more elements can be used in combination. These elements are introduced by partial substitution with or insertion into a phase structure of a rare earth magnet phase mainly constituting an Nd—Fe—B base magnet.

Among the above, $Nd_2Fe_{14}B$ is preferred in terms of a high energy product $(BH)_{max}$ and easy availability.

As long as an Nd—Fe—B base magnet (magnet base material) is a sintered magnet, a commercial product can be used.

In the production of an Nd—Fe—B base magnet (magnet base material), an alloy so as to obtain an Nd—Fe—B base magnet having a desired composition is prepared first. For example, metals, alloys, compounds, and the like corresponding to the composition of an Nd—Fe—B base magnet are melted under vacuum or an inert gas atmosphere such as argon. After this, an alloy having a desired composition is produced using the molten raw materials by an alloy producing process such as a casting method or a strip casting method.

As the alloy, two types of alloy, an alloy with a composition constituting a principal phase in an Nd—Fe—B base magnet (a principal phase alloy) and an alloy with a composition constituting a grain boundary phase (a grain boundary phase alloy), can be used.

Next, the resultant alloy is coarsely ground to obtain grains with a grain diameter of about a few hundred μm. An alloy can be roughly ground using a coarse crusher such as a jaw crusher, brown mill and stamp mill, for example. Alternatively, it can be carried out by allowing an alloy to occlude hydrogen and then inducing hydrogen decrepitation in self-decomposition manner based on a difference in hydrogen occlusion amounts between different phases (hydrogen occlusion decrepitation).

Subsequently, a powder obtained by coarse grinding is further finely pulverized to obtain a raw material powder of a magnet base material with an average grain diameter of about preferably 1 to 10 μm, more preferably 2 to 8 μm, and even more preferably 3 to 6 μm (hereinafter, simply referred to as "raw material powder"). The coarsely ground powder can be finely pulverized using a fine pulverizer such as a jet mill, a ball mill, a vibrational mill or a wet attritor while suitably adjusting conditions such as a pulverization time.

An average grain diameter of the raw material powder can be analyzed (measured) by SEM (scanning electron microscope) observation or TEM (transmission electron microscope) observation, for example. It should be noted that grains not in the spherical or circular shape (cross sectional shape) but in a needle or rod shape in which an aspect ratio is not the same, and grains in an indefinite shape can be contained in a raw material powder and its cross section. Therefore, the average grain diameter of raw material powder as described above is represented by an average value of absolute maximum length in a cross-sectional shape of each grain in an observation image, because the grain shape (or the cross-sectional shape thereof) is not uniform. The absolute maximum length is a maximum length among distances between optional two points on the line showing the outer edge of a grain (or the cross-sectional shape thereof). In addition to this, the absolute maximum length can be obtained by, for example, finding an average value of the crystallite diameter obtained from a half width of diffraction peak of a magnet powder in X-ray diffraction, or a grain diameter of magnet powder obtained from a transmission electron microscope image.

It should be noted that when two types, a principal phase alloy and a grain boundary phase alloy, are prepared in the production of an alloy, a raw material powder may also be prepared by coarsely grinding and finely pulverizing each alloy, and mixing the resultant two types of fine powder.

Next, the raw material powder obtained as described above is molded into a desired shape. The molding is carried out while applying a magnetic field, thereby giving a predetermined orientation to the raw material powder. The molding can be carried out for example by press molding. Specifically, a raw material powder can be molded into a predetermined shape by filling the raw material powder into a mold cavity and then putting the filled powder between an upper punch and a lower punch to apply pressure. The shape obtained by molding is not particularly restricted, and can be changed depending on the desired shape of Nd—Fe—B base magnet (magnet base material), such as the columnar, tubular, board or ring shape. Pressure is preferably applied at 0.5 to 1.4 ton/cm$^2$ during molding. In addition, a magnetic field to be applied is preferably 12 to 20 kOe. It should be noted that as a molding method, wet molding which comprises dispersing a raw material powder in a solvent such as oil to obtain a slurry and molding the slurry can be also applied, as well as dry molding which comprises directly molding a raw material powder as described above.

Next, a molded material is heat-treated in vacuum or in the presence of an inert gas at 1100 to 1210° C. for 1 to 6 hours, for example, to be sintered. By this, a raw material powder is subjected to liquid phase sintering, to obtain a sintered body (a magnet base material for an Nd—Fe—B base magnet) having an increased volume ratio of a principal phase.

A sintered body may be suitably processed into a desired size and shape, and then subjected to surface treatment by treating a surface of the sintered body with an acid solution, for example. Examples of the acid solution used for the surface treatment can include a mixed solution of an aqueous solution such as of nitric acid or hydrochloric acid, with an alcohol. The surface treatment can be carried out by immersing a sintered body in an acid solution or by spraying an acid solution to a sintered body, for example. By such surface treatment, dirt and an oxidized layer adhering to a sintered body can be removed to obtain a clean surface, and an alloy powder described below can be easily applied thereon. The surface treatment may be carried out while applying ultrasonic wave to an acid solution in terms of further preferably removing dirt and an oxidized layer.

(b) Alloy Powder of the Formula (1)

In the method according to the present invention, the Nd—Fe—B base magnet is used for a heat-treatment in a state in which an alloy powder represented by the formula (1) is disposed on its surface. The alloy represented by the formula (1) includes Ca or Li oxide of which has low standard free energy for formation, as well as a rare earth element. Ca or Li functions as an oxygen getter to suppress the oxidation of rare earth element. By this, coercive force of Nd—Fe—B base sintered magnet can be improved while suppressing decrease in remanent magnetic flux density to the minimum.

In the above formula (1), R is only needed to be at least one of rare earth elements including Sc and Y. Specifically, R is one or more selected from the group consisting of scandium (Sc), yttrium (Y), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu). In terms of handleability and diffusibility, R is preferably one or more selected from the group consisting of praseodymium (Pr), dysprosium (Dy), terbium (Tb) and holmium (Ho), and is more preferably terbium (Tb) and/or dysprosium (Dy). In terms of coercive force, R is particularly preferably terbium (Tb).

In the above formula (1), A is Ca or Li. In terms of more effectively suppressing the oxidation of rare earth element, A is preferably Ca.

B is an unavoidable impurity. The "unavoidable impurity" means one(s) which is contained in a raw material in an alloy, and is unavoidably mixed in a production step. The unavoidable impurity is an impurity which is originally unnecessary but is acceptable because it is in a trace amount and does not affect the alloy characteristics. An alloy may contain, for example, Al, Si, Ti, V, Cr, Mn, Ni, Cu, Zn, Ga, Zr, Nb, Mo, Ag, In, Sn, Hf, Ta, W, Pb and/or Bi as the unavoidable impurity in such an amount as that the object and effects of the present invention are not inhibited.

In the above formula (1), x is not less than 2 and not more than 99 ($2 \le x \le 99$), y is not less than 1 and less than x ($1 \le y < x$), and z is not less than 0 and less than y ($0 \le z < y$). In terms of decrease in remanent magnetic flux density, x is preferably not less than 2 and not more than 22 ($2 \le x \le 20$), more preferably not less than 2 and not more than 15 ($2 \le x \le 15$). The x is particularly preferably not less than 2 and not more than 5 ($2 \le x \le 5$) in terms of increase in coercive force. Smaller z is more preferred, and but not restricted to, is $0 \le z \le 0.1y$, for example, and preferably $0 \le z \le 0.01y$. It is preferred that z be substantially 0. In one preferred embodiment of the present invention, $2 \le x \le 20$, $1 \le y < x$, and $0 \le z \le 0.01y$ in the above formula (1). In another preferred embodiment of the present invention, $2 \le x \le 15$, $1 \le y < x$, and $0 \le z \le 0.01y$ in the above formula (1). In a further preferred embodiment of the present invention, $2 \le x \le 10$, $1 \le y < x$, and $0 \le z \le 0.01y$ in the above formula (1). It should be noted that, when a plurality of rare earth elements are contained as R, the above x value represents a total amount thereof. Similarly, when Ca and Li are contained as A, the above y value represents a total amount thereof.

In the above formula (1), because B is an unavoidable impurity, smaller z is preferred, and it is preferred that substantially no B is contained. As used herein, the phrase that "substantially no B is contained" means the case where a content of B is 0.1% by weight or less with respect to the whole alloy. The content of B is more preferably 0.01% by weight or less with respect to the whole alloy (the lower limit is 0% by weight). An alloy which is preferably used in the present invention and contains substantially no B is represented by the following formula (2).

[Chemical Formula 2]

$$R_xA_y \tag{2}$$

In the above formula (2), R, A, x and y are as defined for formula (1).

The alloy represented by the formula (1) used in the present invention is not particularly limited, and specific examples thereof can include $Tb_{20}Ca_1$, $Tb_{15}Ca_1$, $Tb_{10}Ca_1$, $Tb_5Ca_1$, $Tb_3Ca_1$, $Tb_2Ca_1$, $Tb_3Ca_2$, $Tb_{20}Li_1$, $Tb_{10}Li_1$, $Tb_3Li_1$, $Tb_3Li_2$, $Dy_{20}Ca_1$, $Dy_{10}Ca_1$, $Dy_3Ca_1$, $Dy_3Ca_2$, $Dy_{20}Li_1$, $Dy_{10}Li_1$, $Dy_3Li_1$, $Dy_3Li_2$, $Pr_{20}Ca_1$, $Pr_{10}Ca_1$, $Pr_3Ca_1$, $Pr_3Ca_2$, $Pr_{20}Li_1$, $Pr_3Li_1$, $Pr_3Li_2$, $Ho_{20}Ca_1$, $Ho_{10}Ca_1$, $Ho_3Ca_1$, $Ho_3Ca_2$, $Ho_{20}Li_1$, $Ho_{10}Li_1$, $Ho_3Li_1$, $Ho_3Li_2$ $(Tb_{20-a}Dy_a)_{20}Ca_1$ (wherein $0.1 \le a \le 19.9$), $(Tb_{10-a}Dy_a)_{10}Ca_1$ (wherein $0.1 \le a \le 9.9$), $(Tb_{3-a}Dy_a)_3Ca_1$ (wherein $0.1 \le a \le 2.9$), $(Tb_{3-a}Dy_a)_3Ca_2$ (wherein $0.1 \le a \le 2.9$), $(Tb_{20-a}Dy_a)_{20}Li_1$ (wherein $0.1 \le a \le 19.9$), $(Th_{10-a}Dy_a)_{10}Li_1$ (wherein $0.1 \le a \le 9.9$), $(Tb_{3-a}Dy_a)_3Li_1$ (wherein $0.1 \le a \le 2.9$), $(Tb_{3-a}Dy_a)_3Li_2$ (wherein $0.1 \le a \le 2.9$), $(Tb_{20-a}Pr_a)_{20}Ca_1$ (wherein $0.1 \le a \le 19.9$), $(Tb_{10-a}Pr_a)_{10}Ca_1$ (wherein $0.1 \le a \le 9.9$), $(Tb_{3-a}Pr_a)_3Ca_1$ (wherein $0.1 \le a \le 2.9$), $(Tb_{3-a}Pr_a)_3Ca_2$ (wherein $0.1 \le a \le 2.9$), $(Tb_{20-a}Ho_a)_{20}Ca_1$ (wherein $0.1 \le a \le 19.9$), $(Tb_{10-a}Ho_a)_{10}Ca_1$ (wherein $0.1 \le a \le 9.9$), $(Tb_{3-a}Ho_a)_3Ca_1$ (wherein $0.1 \le a \le 2.9$), and $(Tb_{3-a}Ho_a)_3Ca_2$ (wherein $0.1 \le a \le 2.9$), and the like. These compounds may contain an unavoidable impurity as long as the object and effects of the present invention are not inhibited.

The alloy of the formula (1) can be synthesized using a conventionally known alloying means, and an alloying treatment by a solid phase method, a liquid phase method or a gas phase method can be suitably used. More specific examples of alloying means include a mechanical alloying method, an arc melting method, a casting method, a gas atomization method, a liquid quenching method, an ion beam sputtering method, a vacuum deposition method, a plating method, a chemical vapor deposition method, and the like. Among these, the alloy of the formula (1) is preferably synthesized using a mechanical alloying method or an arc melting method, and more preferably synthesized using a mechanical alloying method. In one embodiment of the grain boundary modification of an Nd—Fe—B base magnet of the present invention, the alloy represented by the formula (1) is synthesized by a mechanical alloying method. In the preferred embodiment, an Nd—Fe—B base magnet with an alloy powder alloy of which is synthesized by a mechanical alloying method disposed on the surface thereof is subjected to heat-treatment which will be described below.

Using an alloy synthesized by a mechanical alloying method, coercive force ($H_{cJ}$) of a magnet base material can be further increased while suppressing decrease in remanent magnetic flux density ($B_r$) to a minimum. It is considered that this is because an alloy which is obtained by a mechanical alloying method has a rare earth element and an oxygen getter(s) (Ca and/or Li) distributed with excellent uniformity, although this does not restrict the technical scope of the present invention. In addition, the generation of fume of Ca can be prevented by synthesizing an alloy by a mechanical alloying method, and moreover the alloying treatment and powderization treatment (pulverization treatment) can be carried out in the same step, which is suitable for the industrial production. Of course, an alloy synthesized by a mechanical alloying method can be further used for powderization treatment which will be described below.

The alloying treatment by a mechanical alloying method can be carried out using a conventionally known method. Alloying can be carried out by using a ball mill apparatus (e.g., a planetary ball mill apparatus), charging balls (pulverization balls) and raw materials for an alloy in a pulverization container, and increasing the rotation number to apply high energy. A ratio of the balls filled in the pulverization container is for example 10 to 90%, preferably 20 to 40%, with respect to a volume of the container. In addition, a ratio of the raw material filled in the pulverization container is for example 0.1 to 30% by weight, preferably 1 to 5% by weight, with respect to a weight of the balls. The rotation number of a ball mill apparatus is for example 100 rpm or more, preferably 200 rpm or more. In addition, a time of alloying treatment by a mechanical alloying method is for example an hour or more, preferably 4 hours or more, more preferably 10 hours or more. The coercive force ($H_{cJ}$) of a magnet can be increased by prolonging the alloying treatment time by a mechanical alloying method. The upper limit value of the alloying treatment time is not particularly set, and is normally 72 hours or less, preferably 50 hours or less, more preferably 30 hours or less, in terms of balance between coercive force ($H_{cJ}$) and remanent magnetic flux density ($B_r$).

The method may comprise a step of melting a raw material and a step of rapidly cooling the molten material for solidification, prior to the alloying treatment. In addition, a raw material may be coarsely ground by a coarse crusher or hydrogen occlusion pulverization prior to the alloying treatment.

In the method according to the present invention, the alloy powder is used as a diffusing agent. The powderization of alloy can be carried out by a conventionally known method, and may be carried out by suitably combining the coarse crusher such as a jaw crusher, a brown mill, or a stamp mill as described above, and a fine pulverizer such as a jet mill, a ball mill, a vibrational mill, or a wet attritor, as needed. The grain diameter (diameter) of alloy powder is not particularly restricted, and is for example 500 μm or less, preferably 200 μm or less, and more preferably 100 μm or less, in terms of applicability to a magnet base material. The lower limit of grain diameter is not particularly restricted, and is for example 0.01 μm or more. Alternatively, an alloy powder having a median diameter (diameter) of 0.1 to 200 μm, preferably 1 to 50 μm, more preferably 1 to 22 μm, further preferably 1 to 13 μm, and particularly preferably 1 to 10 μm can be used. The grain diameter (diameter) of powder is a value measured by a laser diffraction particle size analyzer (manufactured by SHIMADZU CORPORATION). The grain diameter of alloy powder can be controlled by suitably adjusting a pulverization time and the like, and grains in a desired grain diameter fraction can be selected using a sieve with an optional mesh size prior to use. It should be noted that the shape of alloy powder is not limited to the spherical shape, and can be grains in the needle shape or an indefinite shape.

The alloy powder can be applied on the surface of an Nd—Fe—B base magnet individually or by mixing two or more types.

In the method according to the present invention, an Nd—Fe—B base magnet having the alloy powder disposed on the surface thereof is used in heat-treatment which will be described below. By this, a rare earth element can be efficiently diffused, and demagnetization at high temperature can be suppressed and prevented, and a high coercive force can be achieved.

Examples of the method for applying an alloy powder to a magnet base material include a method which comprises spraying an alloy powder to a magnet base material, a method which comprises dispersing an alloy powder in a solvent to obtain a slurry and coating the slurry on a magnet base material, and the like. Among these, the method which comprises coating a slurry on a magnet base material is preferred in terms that an alloy powder can be uniformly applied to a magnet base material and diffusion in a later heat-treatment step is favorably caused.

A solvent or dispersion medium used for a slurry is preferably one which can uniformly disperse an alloy powder, and more preferably one which does not contain water in terms of preventing the degradation by oxidation of rare earth element and oxygen getter. Examples of the solvent or dispersion medium used for a slurry include alcohols, aldehydes, ketones (e.g., acetone, methylethylketone, methylisobutylketone, diisobutylketone, cyclohexanone, diacetone alcohol, etc.), waxes which will be described below, and the like. Among these, one or more selected from the group consisting of alcohols having about 1 to 5 carbon atoms such as methanol, ethanol, propanol, isopropanol, 1-butanol, and tert-butanol, and hydrocarbons such as paraffin wax, liquid paraffin, microcrystalline wax, polyethylene wax, polypropylene wax, Fischer-Tropsch wax, ceresin, ozokerite, and Vaseline are preferably used. The solvents or dispersion media used for a slurry can be used individually or two or more solvents or dispersion media can be used in combination.

When a slurry is coated to a magnet base material, a method which comprises immersing a magnet base material in a slurry, and a method which comprises putting a magnet base material in a slurry and stirring the obtained mixture with a predetermined medium may be cited, for example. As the latter method, a ball mill method can be applied, for example. By stirring and crushing with a medium as described above, the alloy powder applied to a magnet base material can be suppressed from being separated, and an existing amount of alloy powder can be stabilized. In addition, a large amount of magnet base material can be treated at a time by such method. It should be noted that the former method by immersion can be more advantageous for application by coating depending on the shape of magnet base material, and thus actually both methods can be suitably selected and used. Furthermore, coating can be carried out by adding a slurry dropwise to a magnet base material.

When using a slurry, an amount of alloy powder contained in a slurry is preferably 1 to 99% by weight, more preferably 5 to 80% by weight, further preferably 5 to 75% by weight, and particularly preferably 20 to 60% by weight. When the amount of alloy powder contained in a slurry is within the above ranges, an alloy powder can be easily uniformly applied to a magnet base material.

Another component other than an alloy powder can be further contained in a slurry as needed. Another component which can be contained in a slurry include calcium hydride and fluorides of a transition element and the like which will be described below, and a dispersing agent to prevent coagulation of alloy powder grains, and the like, for example.

The alloy powder of the formula (1), which contains an oxygen getter(s) (Ca and/or Li), is preferably handled in a low oxygen atmosphere (e.g., in an atmosphere with an oxygen concentration of 100 ppm or less) for the purpose of preventing degradation by oxidation. However, operations under an inert gas atmosphere such as Argon gas or nitrogen gas not only have poor handleability but also require high equipment investment in the industrial-scale production. On the other hand, the present inventors have found that a wax and a urethane resin are able to be used as a stabilizer to prevent the oxidation of an alloy powder. That is, they have found that by using a slurry containing a wax and a urethane resin with an alloy powder, the effect by grain boundary modification with the alloy powder of the formula (1) could be highly exerted even in operations under a high oxygen atmosphere such as in the air. Therefore, in one preferred embodiment of the present invention, the method includes applying a slurry containing one or more stabilizers selected from the group consisting of waxes and urethane resins and the alloy powder to the surface of an Nd—Fe—B base magnet before the heat-treatment.

The "waxes" as used in the description indicate wax esters and aliphatic hydrocarbons. More typical examples of the waxes include, but not limited to, paraffin wax, liquid paraffin, microcrystalline wax, polyethylene wax, polypropylene wax, Fischer-Tropsch wax, montan wax, ceresin, ozokerite, Vaseline, beeswax, spermaceti, Japan wax, carnauba wax, ricebran wax, and sugarcane wax and the like. As a wax, in terms of the effect of preventing the oxidation of an alloy powder, a hydrocarbon selected from the group consisting of paraffin wax, liquid paraffin, microcrystalline wax, polyethylene wax, polypropylene wax, Fischer-Tropsch wax, ceresin, ozokerite and Vaseline is preferably used, and liquid paraffin is more preferably used. The above waxes can be used individually or two or more waxes can be used in combination.

The urethane resin is not particularly restricted as long as it is a compound obtained by the copolymerization of a polyol and a polyisocyanate. Examples of polyol used to produce the urethane resin can include, but not limited to, low-molecular weight polyols such as ethylene glycol, propylene glycol, 1,4-butane diol, 1,6-hexane diol, diethylene glycol, trimethylolpropane, and pentaerythritol; polyester polyols, which are a copolymer of polycarboxylic acid such as succinic acid, adipic acid, sebacic acid, phthalic acid and terephthalic acid and with the low-molecular weight polyol; polyester polyols obtained by ring-opening polymerization reaction of a cyclic ester compound such as □-caprolactone; polyether polyols obtained by addition polymerization of ethylene oxide, propylene oxide and the like to a polyol such as ethylene glycol, propylene glycol, glycerin, sucrose, or bisphenol A, or an amine such as ethylenediamine; polycarbonate polyols obtained by reacting a carbonic acid ester such as dimethyl carbonate and diethyl carbonate or a carbonyl halide such as phosgene with the low-molecular weight polyol, and the like. Examples of polyisocyanates to produce the urethane resin can include, but not limited to, tolylene diisocyanate, hexamethylene diisocyanate, 4,4'-diphenylmethane diisocyanate, cyclohexane diisocyanate, isophorone diisocyanate and the like. The urethane resins can be used individually, or two or more urethane resins can be used in combination.

A stabilizer having a high fluidity around normal temperature like liquid paraffin can be also used as a dispersion medium for a slurry.

An amount of stabilizer contained in a slurry is for example 1 to 99% by weight, preferably 5 to 60% by weight.

An atmosphere when applying an alloy powder to a magnet base material is preferably an inert gas such as nitrogen or argon in terms suppressing the oxidation of an alloy powder. In terms of suppressing the oxidation of an alloy powder, in one embodiment, operations from an alloying treatment to obtain an alloy powder to a heat-treatment of a magnet base material having a diffusing agent applied thereto are carried out under an atmosphere of an inert gas such as nitrogen or argon. In a certain embodiment, operations from the step of preparing a slurry in which the oxidation of an alloy powder particularly easily proceeds to a heat-treatment of a magnet base material having a diffusing agent applied thereto are carried out under an atmosphere of an inert gas such as nitrogen or argon.

In the coating of a coating liquid such as a slurry containing an alloy powder on the surface of a magnet base material, because the existing amount of alloy powder is easily controlled, a magnet base material after coating is preferably dried at 20 to 80° C. for a minute to 60 minutes, for example.

Although an alloy powder can be applied to a magnet base material in a method as described above, an amount of alloy powder present on the surface of an Nd—Fe—B base magnet is preferably within a fixed range, in terms of improving magnetic characteristics (particularly high coercive force). Specifically, the amount of alloy powder is preferably 0.05 to 10% by weight, more preferably 0.1 to 5% by weight, and further preferably 0.2 to 3% by weight, with respect to the weight of Nd—Fe—B base magnet (a total weight of magnet base material and alloy powder, and when using a plurality of alloy powders, a total amount thereof).

Although an alloy powder is preferably covered on the entire surface of an Nd—Fe—B base magnet, partial covering on the surface of an Nd—Fe—B base magnet is involved in the present invention as long as that coercive force is increased.

(c) Calcium Hydride

In one preferred embodiment of the present invention, an Nd—Fe—B base magnet having calcium hydride further disposed on the surface thereof is heat-treated.

By heat-treating an Nd—Fe—B base magnet having calcium hydride ($CaH_2$), as well as an alloy powder, further disposed on the surface thereof, coercive force can be further remarkably increased. It is considered that this is because calcium hydride is oxidized prior to an alloy powder, to further promote the diffusion of rare earth element, although this does not restrict the technical scope of the present invention.

Calcium hydride can be applied to the surface of an Nd—Fe—B base magnet in the same manner as for the alloy powder as described above. Calcium hydride can be applied simultaneously with an alloy powder to the surface of an Nd—Fe—B base magnet, or can be applied before or after applying an alloy powder. For example, a coating liquid containing calcium hydride can be coated before forming a coating of an alloy powder or after forming a coating of an alloy powder. In terms of workability and a decrease in uneven distribution, calcium hydride is preferably coated simultaneously with an alloy powder on the surface of an Nd—Fe—B base magnet by adding calcium hydride to a slurry of the alloy powder.

An amount of calcium hydride present on the surface of an Nd—Fe—B base magnet is preferably 0.001 to 5% by weight as an amount with respect to the weight of Nd—Fe—B base magnet (a total weight of magnet base material and calcium hydride), in terms of enhancing coercive force. It is more preferably 0.01 to 3% by weight, even more preferably 0.25 to 1% by weight, in terms of further enhancing coercive force.

In addition, an amount of calcium hydride can be 0.5 to 80 parts by weight, is preferably 1 to 60 parts by weight, and more preferably 5 to 50 parts by weight, based on 100 parts by weight of an alloy powder existing on the surface of an Nd—Fe—B base magnet. If it is within such an amount as described above, the effects of increasing coercive force can be particularly effectively exerted.

(d) Transition Element Fluoride, Etc.

In one preferred embodiment of the present invention, an Nd—Fe—B base magnet having at least one selected from the group consisting of oxide, fluoride and acid fluoride of a transition element selected from the group consisting of Al, B, Cu, Ni, Co, Zn or Fe further disposed on the surface thereof is heat-treated. As used herein, the "oxide, fluoride and acid fluoride of a transition element selected from the group consisting of Al, B, Cu, Ni, Co, Zn or Fe" are also simply referred to as "a transition element fluoride, etc."

By heat-treating an Nd—Fe—B base magnet having transition element fluoride, etc., as well as an alloy powder, further disposed on the surface thereof, coercive force can be further remarkably increased. It is considered that this is because when a transition element fluoride, etc. is used, the diffusion of a rare earth element to a grain boundary portion can be promoted, unlike a case where an oxide or fluoride of a rare earth element is used, although this does not restrict the technical scope of the present invention.

More specific examples of transition element fluorides, etc. which can be used for the method according to the present invention can include, but not limited to, $AlF_3$, $BF_3$, CuF, $CuF_2$, $NiF_2$, $CoF_2$, $CoF_3$, $ZnF_2$, $FeF_3$, $Al_2O_3$, $B_2O_3$, $Cu_2O$, CuO, NiO, $Ni_2O_3$, CoO, $Co_2O_3$, $Co_3O_4$, ZnO, FeO, $Fe_2O_3$, AlOF (aluminum fluoride oxide), and the like. Among these, $AlF_3$ is preferable in terms of enhancing coercive force, and $NiF_2$ is preferable in terms of maintaining remanent magnetic flux density. The transition element fluorides, etc. can be used individually or two or more transition element fluorides, etc. can be used in combination.

The transition element fluoride, etc. can be applied to the surface of an Nd—Fe—B base magnet in the same manner as for the calcium hydride as described above. In terms of workability and decrease in uneven distribution, the transition element fluoride, etc. is preferably coated simultaneously with an alloy powder on the surface of an Nd—Fe—B base magnet by adding the transition element fluoride, etc. to a slurry of the alloy powder. The calcium hydride and the transition element fluoride, etc. can be used in combination for the present invention.

An amount of transition element fluoride, etc. present on the surface of an Nd—Fe—B base magnet is not particularly restricted. In terms of balance between coercive force and remanent magnetic flux density, the amount of transition element fluoride, etc. is for example preferably 0.01 to 3% by weight and more preferably 0.03 to 1% by weight, as an amount with respect to the weight of Nd—Fe—B base magnet (a total weight of magnet base material and transition element fluoride, etc., and when using a plurality of transition element fluorides, etc., a total amount thereof).

In addition, an amount of transition element fluoride, etc. can be 1 to 80 parts by weight and is preferably 5 to 50 parts by weight, based on 100 parts by weight of an alloy powder existing on the surface of an Nd—Fe—B base magnet. If it is within such an amount as described above, the effects of increasing coercive force can be particularly effectively exerted.

(2) Heat-Treatment

In the method according to the present invention, an Nd—Fe—B base magnet prepared as described above (in which an alloy powder exists on the surface) is heat-treated. By the heat-treatment, an alloy diffuses to a grain boundary and coercive force of a magnet can be improved. In one aspect of the present invention, the heat-treatment is carried out at a temperature lower than a sintering temperature of a magnet, in terms of preventing a rare earth element from being incorporated into a principal phase crystal. In another embodiment of the present invention, the heat-treatment is carried out at 200° C. or higher and 1050° C. or lower from the same viewpoint. In one embodiment of the present invention, the heat-treatment is carried out at the temperature lower than a sintering temperature of a magnet and between 200° C. and 1050° C.

The heat-treatment can be carried out using a sintering furnace, a hot plate, an oven and a furnace.

A temperature of heat-treatment is for example preferably 700 to 1000° C., more preferably 800 to 1000° C., and particularly preferably 900° C. or higher and lower than 1000° C. In a certain embodiment, the temperature of heat-treatment is lower than a sintering temperature. In addition, a heat-treatment time is for example a minute to 30 hours, and more preferably 1 to 10 hours. In one preferred embodiment of the present invention, the heat-treatment is carried out at 200° C. or higher and 1050° C. or lower for a minute to 30 hours, in terms of coercive force of a magnet and efficient workability. In another preferred embodiment of the present invention, the heat-treatment is carried out at 700 to 1000° C. for 1 to 10 hours.

The oxidation of rare earth element can be suppressed by carrying out the heat-treatment under a low oxygen environment. Therefore, in the method according to the present invention, the heat-treatment is carried out in vacuum or an inert gas. A pressure of an atmosphere when the heat-treatment is carried out in vacuum is for example $1.0\times10^{-2}$ Pa or less, $5.0\times10^{-2}$ Pa or less, more preferably $1.0\times10^{-3}$ Pa or less. Alternatively, an atmosphere gas during the heat-treatment can be substituted for an inert gas such as nitrogen, argon, or a mixed gas of nitrogen and argon for the heat-treatment. An oxygen concentration in an atmosphere during the heat-treatment can be for example 10 ppm or less, in terms of preventing the oxidation of a rare earth element.

A depth of diffusion of a rare earth metal can be normally in the approximate range of 20 to 1000 μm from the surface of a magnet. It is ascertained from analytical results of EPMA (Electron Probe Micro-Analyzer) that a configuration of a grain boundary phase after the diffusion and penetration is an M-Nd—Fe—O (M is a rare earth metal) system. A thickness of the grain boundary phase is estimated to be about 10 to 200 nm.

In the present invention, an aging treatment is preferably further carried out after the heat-treatment. By this, coercive force can be further improved. The aging treatment can be carried out together with the heat-treatment in the same step (i.e., in the same container following the heat-treatment step), or can be carried out in another container, and the former is preferred in terms of simplification of operations. The conditions of the aging treatment are not particularly restricted. A temperature of the aging treatment is for example preferably 200 to 700° C., and more preferably 500 to 650° C. A time of the aging treatment is preferably 10 minutes to 3 hours, and more preferably 30 minutes to 2 hours. Under such conditions, uniform growth of an Nd-rich phase of grain boundaries can be enhanced and, thereby, coercive force can be further improved. The aging treatment can be also carried out in vacuum or an inert gas as described in the heat-treatment.

After the heat-treatment and, as desired, the aging treatment, the magnet is further cut to form a plurality of magnets having a predetermined shape and size. A cutting method is not particularly restricted, and a known method can be used. For example, a method which comprises using a disk-shaped cutting edge having diamonds or green corundum abrasive grains fixed on the perimeter portion thereof, fixing a magnet piece thereon, and cutting the magnet one by one, and a method which comprises cutting a plurality of magnets simultaneously with a cutter (multi-saw) provided with a plurality of edges can be used.

(Applications of Nd—Fe—B-Base Sintered Magnet with Modified Grain Boundary)

In one embodiment of the present invention, there is provided a material with modified grain boundary, which is obtainable by the method as described above. In another embodiment of the present invention, there is provided a method for producing a material with modified grain boundary, which comprises treating an Nd—Fe—B-base sintered magnet by the method for modifying grain boundary as described above. In a material with modified grain boundary obtained by the grain boundary modification method (an Nd—Fe—B-base sintered magnet with modified grain boundary), a rare earth element(s) (or an alloy of the formula (1)) is selectively enriched in a crystal grain boundary phase. The substitution in a small scale of Nd in the principal phase crystal with a rare earth element cannot be completely denied, and the substitution is not uniform. Thus, although a crystal structure of the principal phase and the grain boundary phase after the modification cannot be unambiguously represented, the material shows excellent coercive force and remanent magnetic flux density both.

Examples of applications for grain boundary diffused (grain boundary modified) Nd—Fe—B base magnet include a magnet motor and the like. A magnet motor using the magnet having a high coercive force of the present embodiment is excellent on the point that equal characteristics can be obtained in a light, small high-performance system.

Figure 1B:
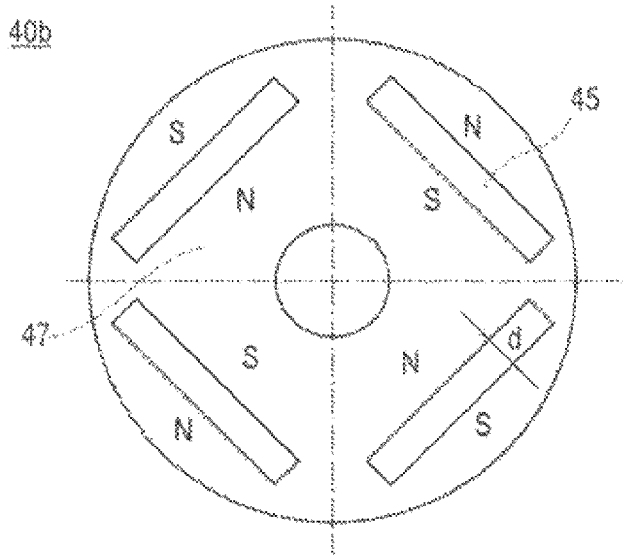
FIG. 1*b* is a cross-sectional schematic view which schematically shows a rotor structure of an interior permanent magnet synchronous motor (IMP or IPMSM)

FIG. 1*a* is a cross-sectional schematic view which schematically shows a rotor structure of a surface permanent magnet synchronous motor (SMP or SPMSM). FIG. 1*b* is a cross-sectional schematic view which schematically shows a rotor structure of an interior permanent magnet synchronous motor (IMP or IPMSM). The surface permanent magnet synchronous motor 40*a* shown in FIG. 1*a* comprises a grain boundary diffused (grain boundary modified) Nd—Fe—B base magnet 41 of the present embodiment directly assembled to (applied on) a rotor 43 for a surface permanent magnet synchronous motor. In the surface permanent magnet synchronous motor 40*a*, magnets 41 cut into a desired size, as described in the present embodiments, are assembled to (applied on) the surface permanent magnet synchronous motor 40*a*. The surface permanent magnet synchronous motor 40*a* can be obtained by magnetizing the magnet 41. It can be also said that it is superior to the interior permanent magnet synchronous motor 40*b* on this point. In particular, the surface permanent magnet synchronous motor is superior on the point that even when the rotor is rotated at a high speed by centrifugal force, the magnet 41 is not separated from the rotor 43 and is easily used. On the other hand, the interior permanent magnet synchronous motor 40*b* shown in FIG. 1*b* comprises a magnet 45 of the present embodiment fixed by press (insertion) in an embedded groove formed in a rotor 47 for an interior permanent magnet synchronous motor. In the interior permanent magnet synchronous motor 40*b*, magnets cut into the same shape and thickness as of the embedded groove are used. In this case, since a shape of magnet 45 is in the plate shape, it is superior on the point that the forming and cutting of the magnet 45 are relatively easy compared to those of the surface permanent magnet synchronous motor 40*a*, which is required to form a material in the production of the magnet 41 into a curved surface shape or to cut and process the magnet 41 itself. It should be noted that the present embodiments are not restricted only to the specific motors as described above, but can be applied in a wide range of areas. That is, the Nd—Fe—B base magnet is only needed to have a shape corresponding to each application in an extremely wide range of areas in which an Nd—Fe—B base magnet is used, such as the household electronic appliance areas including speaker, headphone, winding motor for cameras, focus actuator, rotary head drive motor for video devices and the like, zoom motor, focus motor, capstan motor, optical pickup (for example, CD, DVD, blue-ray), air-conditioning compressor, fan motor for outdoor units, and electric shaver motor; computer peripheral equipment and office automation equipment including voice coil motor, spindle motor, stepping motor, plotter, printer actuator, dot printer print head, and copy rotation sensor; measurement, communication and other precision equipment areas including watch stepping motor, vibrating motor for a variety of meters, pagers and mobile phones (including mobile information terminal), recorder pen drive motor, a variety of plasma sources for accelerator, radiant undulator, polarization magnet, ion source, and semiconductor manufacturing equipment, electron polarization and magnetic penetration bias; the medical area, including permanent magnet MRI, electrocardiograph, electroencephalograph, dental drill motor, tooth fixing magnet, and magnetic necklace; FA area, including AC servomotor, synchronous motor, brake, clutch, torque coupler, transfer linear motor, and reed switch; automotive electronics area including retarder, ignition coil trans, ABS sensor, rotation and position detection sensor, suspension control sensor, door lock actuator, ISCV actuator, electric vehicle motor, hybrid vehicle drive motor, fuel-cell vehicle drive motor, brushless DC motor, AC servomotor, AC induction motor, power steering, car air conditioner, and optical pickup of car navigation. It is needless to say, however, that applications for which the Nd—Fe—B-base sintered magnet of the present embodiments is used are not restricted only to a part of products (parts) as described above, and the Nd—Fe—B-base sintered magnet of the present embodiments can be applied to all applications for which an Nd—Fe—B-base sintered magnet is currently used.

EXAMPLES

The effects of the present invention will now be described by way of Examples and Comparative Examples below. It should be noted, however, that the technical scope of the present invention is not restricted only to the examples described below.

In the description, the coercive force ($H_{cj}$) and remanent magnetic flux density ($B_r$) were measured by the following methods.

(Measurement of Coercive Force ($H_{cj}$) and Remanent Magnetic Flux Density ($B_r$))

Magnetization characteristics were measured using a pulse B—H curve tracer manufactured by Nihon Denji Sokki Co., Ltd., and the coercive force ($H_{cj}$) and remanent magnetic flux density ($B_r$) were determined.

Example 1

An Nd—Fe—B base magnet [composition: $Nd_2Fe_{14}B$; $B_r$=1.41 (T), $H_{cj}$=0.98 (MA/m), size 3 mm×3 mm×2.8 mm, manufactured by Shin-Etsu Chemical Co., Ltd., and model number: N52] was used as a magnet base material A (also referred to as "base material A").

$Tb_{20}Ca_1$ obtained using Tb metal and Ca metal by arc melting was pulverized with a ball mill into a grain diameter of 50 μm or less, to obtain an alloy powder. A grain diameter of alloy powder, as used herein, was measured with a laser diffraction particle size analyzer. Then, the alloy powder, which was used as a diffusing agent, was added to 1-butanol (anhydrous) so as to give a concentration of the alloy powder of 30% by weight, to prepare a slurry. The magnet base material A as above was immersed in the slurry (room temperature (25° C.)) and then dried at 30° C. for 10 minutes. By this, the diffusing agent was applied to the surface of the magnet base material A at a proportion of 1% by weight (existing rate) with respect to the total weight of magnet (the total weight of the magnet base material A and the diffusing agent).

Subsequently, the resultant magnet was heat-treated using a vacuum furnace at 950° C. for 6 hours under vacuum ($1.0\times10^{-3}$ Pa or less). After the heat-treatment, an aging treatment was successively carried out at 550° C. for 2 hours. The resultant magnet after grain boundary modification (material with modified grain boundary) is referred to as M1. In this Example, the operations from the alloying of Tb metal and Ca metal to the heat-treatment of the magnet base material with the diffusing agent applied thereon were carried out in an Ar atmosphere.

Example 2

An Nd—Fe—B base magnet was subjected to grain boundary modification in the same manner as in Example 1 except that $Tb_{10}Ca_1$ was used instead of $Tb_{20}Ca_1$. The resultant magnet after grain boundary modification (material with modified grain boundary) is referred to as M2.

Example 3

An Nd—Fe—B base magnet was subjected to grain boundary modification in the same manner as in Example 1 except that $Tb_3Ca_2$ was used instead of $Tb_{20}Ca_1$. The resultant magnet after grain boundary modification (material with modified grain boundary) is referred to as M3.

Example 4

An alloy powder of $Tb_{20}Ca_1$ was obtained in the same manner as in Example 1. Separately, $AlF_3$ and $CaH_2$ with a grain diameter of 50 μm or less were prepared. An Nd—Fe—B base magnet was subjected to grain boundary modification in the same manner as in Example 1 except that a slurry containing $T_{20}Ca_1$, $AlF_3$ and $CaH_2$ at a weight ratio of 57:20:23 (w:w:w) at a total concentration of 50% by weight was used instead of the slurry in Example 1. An existing rate was set to 1% by weight as a total weight of $Tb_{20}Ca_1$, $AlF_3$ and $CaH_2$ with respect to a total weight of the magnet base material A, $Tb_{20}Ca_1$, $AlF_3$ and $CaH_2$. The resultant magnet after grain boundary modification (material with modified grain boundary) is referred to as M4.

Example 5

An Nd—Fe—B base magnet was subjected to grain boundary modification in the same manner as in Example 4 except that a weight ratio of $Tb_{20}Ca_1$, $AlF_3$ and $CaH_2$ was changed to 67:7:26 (w:w:w). The resultant magnet after grain boundary modification (material with modified grain boundary) is referred to as M5.

Example 6

An Nd—Fe—B base magnet was subjected to grain boundary modification in the same manner as in Example 4 except that $NiF_2$ was used instead of $AlF_3$ and a weight ratio of $Tb_{20}Ca_1$, $NiF_2$ and $CaH_2$ was changed to 87:10:3 (w:w:w). The resultant magnet after grain boundary modification (material with modified grain boundary) is referred to as M6.

Comparative Example 1

An Nd—Fe—B base magnet was subjected to grain boundary modification in the same manner as in Example 1 except that $TbF_3$ was used instead of $Tb_{20}Ca_1$. The resultant magnet after grain boundary modification (material with modified grain boundary) is referred to as C1.

Comparative Example 2

An Nd—Fe—B base magnet was subjected to grain boundary modification in the same manner as in Example 1 except that a slurry containing $TbF_3$ and Al at a weight ratio of 87:13 (w:w) at a total concentration of 30% by weight was used instead of the slurry in Example 1. The resultant magnet after grain boundary modification (material with modified grain boundary) is referred to as C2.

Comparative Example 3

$TbF_3$ was disposed to a surface of the magnet base material A by using $TbF_3$ instead of $Tb_{20}Ca_1$ in Example 1. Then, the resultant magnet and Ca metal (20 mg) were wrapped by Mo metal foil, which was placed in a quartz tube (outer diameter 10 mm, inner diameter 7 mm, length 100 mm). Air in this quartz tube was discharged to a reduced pressure of $1.0\times10^{-3}$ Pa or less, and then sealed. Furthermore, this silica tube was heat-treated in the atmosphere at 950° C. for 6 hours. After the heat-treatment, an aging treatment was successively carried out at 550° C. for 2 hours for grain boundary modification. The resultant magnet after grain boundary modification (material with modified grain boundary) is referred to as C3.

The remanent magnetic flux density ($B_r$) and coercive force ($H_{cj}$) were measured for the magnets M1 and M6 and C1 and C3 for which a grain boundary modification treatment was carried out as described above. The results are shown in Table 1 and FIG. 2.

TABLE 1

| (Table 1) | Magnet | Diffusing agent | $B_r$ (T) | $H_{cj}$ (MA/m) |
|---|---|---|---|---|
| Example 1 | M1 | $Tb_{20}Ca_1$ | 1.39 | 1.31 |
| Example 2 | M2 | $Tb_{10}Ca_1$ | 1.34 | 1.64 |
| Example 3 | M3 | $Tb_3Ca_2$ | 1.36 | 1.83 |
| Example 4 | M4 | $Tb_{20}Ca_1$:$AlF_3$:$CaH_2$ = 57:20:23 (w:w:w) | 1.38 | 1.66 |
| Example 5 | M5 | $Tb_{20}Ca_1$:$AlF_3$:$CaH_2$ = 67:7:26 (w:w:w) | 1.35 | 1.95 |
| Example 6 | M6 | $Tb_{20}Ca_1$:$NiF_2$:$CaH_2$ = 87:10:3 (w:w:w) | 1.39 | 1.57 |
| Comparative Example 1 | C1 | $TbF_3$ | 1.29 | 1.47 |
| Comparative Example 2 | C2 | $TbF_3$:Al = 87:13 (w:w) | 1.30 | 1.69 |
| Comparative Example 3 | C3 | $TbF_3$ + Ca vapor | 1.33 | 1.67 |
| Magnet base material A | | | 1.41 | 0.98 |

As shown in Table 1 and FIG. 2, it is noted that by the method for modifying grain boundary according to the present invention, coercive force ($H_{cj}$) of a magnet base material can be increased while suppressing decrease in remanent magnetic flux density ($B_r$) to the minimum.

Example 7

An Nd—Fe—B base magnet [composition: $Nd_2Fe_{14}B$; $B_r$=1.35 (T), $H_{cj}$=1.47 (MA/m), size 7 mm×7 mm×3 mm] was used as a magnet base material B (also referred to as "base material B").

An alloy ($Tb_3Ca_1$) obtained using Tb metal and Ca metal (Tb:Ca=12:1 (w:w)) by arc melting was pulverized with a ball mill, to obtain an alloy powder.

Then, the alloy powder, which was used as a diffusing agent, was added to 1-butanol (anhydrous) so as to give a concentration of the alloy powder of 50% by weight, to prepare a slurry. The magnet base material B as above was immersed in the slurry (25° C.) and then dried at 30° C. for 10 minutes. By this, the diffusing agent was applied to the surface of the magnet base material B at a proportion of 1% by weight (existing rate) with respect to the total weight of magnet (the total weight of the magnet base material B and the diffusing agent).

Subsequently, the resultant magnet was heat-treated using a vacuum furnace at 950° C. for 6 hours under vacuum ($5.0\times10^{-3}$ Pa or less). After the heat-treatment, an aging treatment was successively carried out at 550° C. for 2 hours. The resultant magnet after grain boundary modification (material with modified grain boundary) is referred to as M7. In this Example, the operations from the alloying of Tb metal and Ca metal to the heat-treatment of the magnet base material with the diffusing agent applied thereon were carried out in an Ar atmosphere with an oxygen concentration of 100 ppm or less (in a glove box).

Examples 8 to 14

An Nd—Fe—B base magnet [composition: $Nd_2Fe_{14}B$; $B_r$=1.35 (T), =1.47 (MA/m), size 7 mm×7 mm×2.35 mm] was used as a magnet base material B (also referred to as "base material B").

Tb metal and Ca metal were used at a weight ratio of 12:1 (Tb:Ca) in an alloying treatment by a mechanical alloying method as described below. In this case, Tb metal and Ca metal were powdered into a grain diameter (diameter) of about 10 mm or less prior to use in the alloying treatment.

The alloying treatment by the mechanical alloying method was carried out using a planetary ball mill apparatus (High G HBX-284E, manufactured by Kurimoto, Ltd., airtight container: made of SUS, ball: made of SUS, ϕ10 mm or 15 mm) under the following conditions. In this case, a ball filled rate was set to be 30% with respect to a container volume, and a filled rate of a raw material was 16% by weight (Examples 8 to 11) or 1% by weight (Examples 12 to 14) with respect to a ball weight. In addition, raw materials were put into the airtight container and a processed product was taken out in an Ar gas atmosphere with an oxygen concentration of 100 ppm or less (in a glove box).

TABLE 2

| Example | Charged Amount of raw materials Tb + Ca (g) | Mixed ratio of raw materials Tb:Ca (wt) | Treated time (hr) | Amount of ball (g) | Diameter of ball (mm) | Rotation rate (Revolution, rpm) |
|---|---|---|---|---|---|---|
| 8 | 54 | 12:1 | 6 | 337 | ϕ10 | 425 |
| 9 | 54 | 12:1 | 24 | 337 | ϕ10 | 425 |
| 10 | 54 | 12:1 | 6 | 337 | ϕ15 | 425 |
| 11 | 54 | 12:1 | 24 | 337 | ϕ15 | 425 |
| 12 | 3.8 | 12:1 | 2 | 337 | ϕ10 | 300 |
| 13 | 3.8 | 12:1 | 6 | 337 | ϕ10 | 300 |
| 14 | 3.8 | 12:1 | 12 | 337 | ϕ10 | 300 |

Magnets after grain boundary modification (materials with modified grain boundary) M8 to M14 were obtained in the same manner as in Example 7 except that the alloy powder ($Tb_3Ca_1$) obtained by the mechanical alloying method as described above was used as a diffusing agent.

Figure 3A:
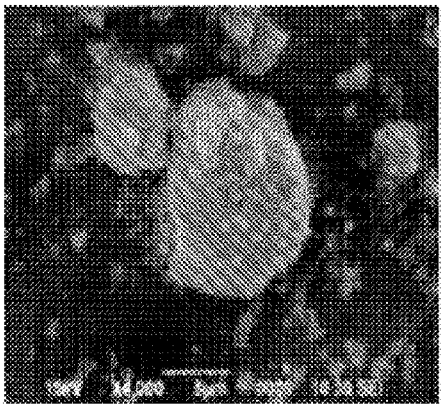
FIGS. 3*a*-3*d* are images of a magnet M9 in Example 9 measured by an electron microscope (SEM) (FIG. 3*a*, 4000 times), and SEM-EDS
Figure 3B:
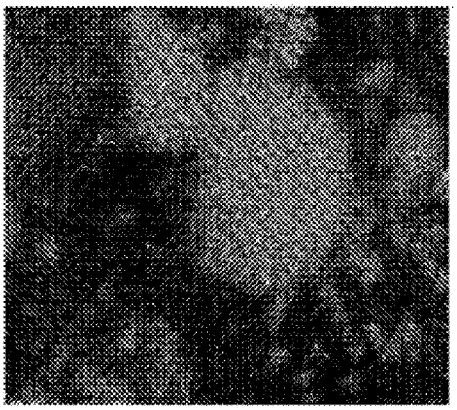
Figure 3C:
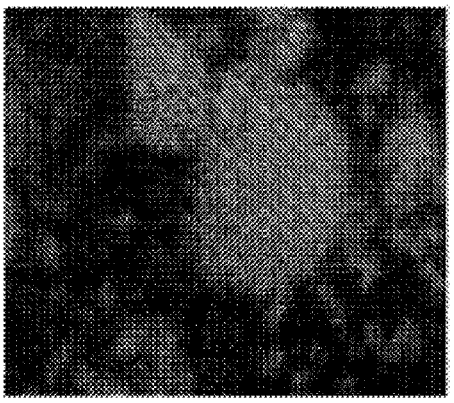
Figure 3D:
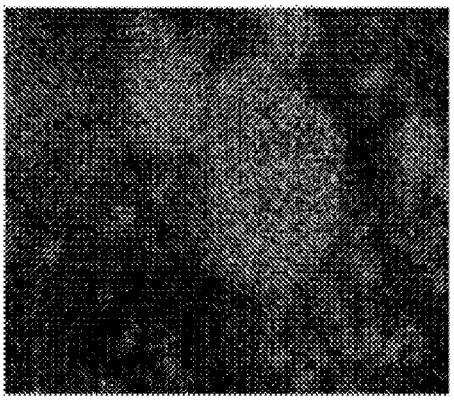

The remanent magnetic flux density ($B_r$) and coercive force ($H_{cj}$) of the magnets M7 to M14 were measured. The results are shown in Table 3. Also, FIG. 3*a* shows an electron microscopic (SEM) image of the magnet M9 in Example 9 (4000 times, measuring apparatus: JCM-5700 manufactured by JEOL), and FIGS. 3*b* to 3*d* show an image of the magnet M9 measured by SEM-EDS (FIG. 3*b*: Ca, FIG. 3*c*: Tb, FIG. 3*d*: Ca and Tb).

TABLE 3

| (Table 3) | Magnet | Median diameter of diffusing agent (D50) (μm) | $B_r$ (T) | $H_{cj}$ (MA/m) |
|---|---|---|---|---|
| Example 7 | M7 | 23.0 | 1.28 | 2.20 |
| Example 8 | M8 | 14.9 | 1.32 | 2.23 |
| Example 9 | M9 | 6.3 | 1.30 | 2.45 |
| Example 10 | M10 | 19.6 | 1.31 | 2.28 |
| Example 11 | M11 | 12.4 | 1.30 | 2.40 |
| Example 12 | M12 | 21.8 | 1.31 | 2.34 |
| Example 13 | M13 | 7.2 | 1.29 | 2.50 |
| Example 14 | M14 | 5.9 | 1.29 | 2.52 |
| Magnet base material B | | | 1.35 | 1.47 |

It is noted that by synthesizing an alloy powder by a mechanical alloying method as described above, coercive force ($H_{cj}$) of a magnet base material can be further increased while suppressing decrease in remanent magnetic flux density to the minimum.

As shown in FIGS. 3*a*-3*d*, it is noted that Tb and Ca are uniformly diffused in the alloy powder synthesized by a mechanical alloying method.

REFERENCE SIGNS LIST

40*a* Surface permanent magnet synchronous motor,
40*b* Interior permanent magnet synchronous motor,
41 Magnet for surface permanent magnet synchronous motor,
43 Rotor for surface permanent magnet synchronous motor,
45 Magnet for interior permanent magnet synchronous motor,
47 Rotor for interior permanent magnet synchronous motor,
d Thickness of embedded groove provided in rotor for interior permanent magnet synchronous motor.

The invention claimed is:

1. A method for modifying grain boundary of Nd—Fe—B base magnet, which comprises heat-treating an Nd—Fe—B base magnet with an alloy powder represented by the following chemical formula (1) disposed on a surface of the Nd—Fe—B base magnet in vacuum or in an inert gas at a temperature lower than a sintering temperature of the Nd—Fe—B base magnet;

$$R_xA_yB_z \quad (1)$$

wherein R represents at least one rare earth element, A represents Ca or Li, B represents an unavoidable impurity, and $2 \le x \le 99$, $1 \le y < x$, and $0 \le z < 0.1$.

2. A method for modifying grain boundary of Nd—Fe—B base magnet, which comprises heat-treating an Nd—Fe—B base magnet with an alloy powder represented by the following chemical formula (1) disposed on a surface of the Nd—Fe—B base magnet in vacuum or in an inert gas at a temperature in the range of 200° C. to 1050° C.;

$$R_xA_yB_z \quad (1)$$

wherein R represents at least one rare earth element, A represents Ca or Li, B represents an unavoidable impurity, and $2 \le x \le 40$, $1 \le y < x$, and $0 \le z < 0.1$.

3. The method according to claim 1, wherein the heat-treatment is subjected to the Nd—Fe—B base magnet which further comprises calcium hydride on the surface of the Nd—Fe—B base magnet.

4. The method according to claim 1, wherein the heat-treatment is subjected to the Nd—Fe—B base magnet which further comprises at least one selected from the group consisting of an oxide, fluoride and acid fluoride of a transition element selected from the group consisting of Al, B, Cu, Ni, Co, Zn or Fe on the surface of the Nd—Fe—B base magnet.

5. The method according to claim 1, wherein R is Tb.

6. The method according to claim 1, wherein A is Ca.

7. The method according to claim 1, wherein the heat-treatment is carried out at a temperature in the range of 200° C. to 1050° C. for a period in the range of one minute to 30 hours.

8. The method according to claim 1, wherein the alloy represented by the formula (1) is synthesized by a mechanical alloying method.

9. The method according to claim 1, which comprises, prior to the heat-treatment, applying a slurry containing one or more stabilizers selected from the group consisting of waxes and urethane resins and the alloy powder to the surface of the Nd—Fe—B base magnet.

10. The method according to claim 2, wherein the heat-treatment is subjected to the Nd—Fe—B base magnet which further comprises calcium hydride on the surface of the Nd—Fe—B base magnet.

11. The method according to claim 2, wherein the heat-treatment is subjected to the Nd—Fe—B base magnet which further comprises at least one selected from the group consisting of an oxide, fluoride and acid fluoride of a transition element selected from the group consisting of Al, B, Cu, Ni, Co, Zn or Fe on the surface of the Nd—Fe—B base magnet.

12. The method according to claim 2, wherein R is Tb.

13. The method according to claim 2, wherein A is Ca.

14. The method according to claim 2, wherein the heat-treatment is carried out at a temperature in the range of 200° C. to 1050° C. for a period in the range of one minute to 30 hours.

15. The method according to claim 2, wherein the alloy represented by the formula (1) is synthesized by a mechanical alloying method.

16. The method according to claim 2, which comprises, prior to the heat-treatment, applying a slurry containing one or more stabilizers selected from the group consisting of waxes and urethane resins and the alloy powder to the surface of the Nd—Fe—B base magnet.

* * * * *